US008113220B2

(12) United States Patent
Inglese

(10) Patent No.: US 8,113,220 B2
(45) Date of Patent: Feb. 14, 2012

(54) WET (PLASTIC) AND DRY CONCRETE DISPOSAL DEVICE

(76) Inventor: Pat Inglese, Smyrna, GA (US)

( * ) Notice: Subject to any disclaimer, the term of this patent is extended or adjusted under 35 U.S.C. 154(b) by 0 days.

(21) Appl. No.: 12/142,711

(22) Filed: Jun. 19, 2008

(65) Prior Publication Data

US 2008/0251471 A1 Oct. 16, 2008

Related U.S. Application Data

(62) Division of application No. 10/722,153, filed on Nov. 25, 2003, now abandoned.

(51) Int. Cl.
*B08B 9/093* (2006.01)

(52) U.S. Cl. ..... 134/104.1; 134/104.4

(58) Field of Classification Search ..... 210/499, 210/498, 508, 800; 134/104.1, 104.4
See application file for complete search history.

(56) References Cited

U.S. PATENT DOCUMENTS

| | | | | |
|---|---|---|---|---|
| 217,906 | A | 7/1879 | Shaler | |
| 3,419,151 | A | 12/1968 | Smith et al. | |
| 3,491,151 | A * | 1/1970 | Bader | 564/301 |
| 3,495,762 | A | 2/1970 | Verbic | |
| 3,745,775 | A * | 7/1973 | Kahn | 405/222 |
| 3,805,535 | A | 4/1974 | Van Weele | |
| 4,016,978 | A | 4/1977 | Danna, Jr. | |
| 4,113,146 | A | 9/1978 | Williamson | |
| 4,143,796 | A | 3/1979 | Williamson et al. | |
| 4,154,671 | A * | 5/1979 | Borges | 209/10 |
| 4,194,652 | A | 3/1980 | Williamson et al. | |
| 4,224,970 | A | 9/1980 | Williamson et al. | |
| 4,253,507 | A | 3/1981 | Williamson et al. | |
| 4,285,808 | A * | 8/1981 | Horton | 209/17 |
| 4,340,379 | A | 7/1982 | Williamson et al. | |
| 4,419,232 | A | 12/1983 | Arntyr et al. | |
| 4,457,456 | A | 7/1984 | Derby et al. | |
| 4,479,243 | A | 10/1984 | Derby et al. | |
| 4,646,357 | A | 2/1987 | Nattrass | |
| 4,664,957 | A | 5/1987 | Van De Pol | |
| 4,691,371 | A | 9/1987 | Derby | |
| 4,759,473 | A | 7/1988 | Derby et al. | |
| 4,811,419 | A * | 3/1989 | Derby | 383/67 |
| 4,833,008 | A | 5/1989 | Derby | |
| 4,865,218 | A | 9/1989 | Derby et al. | |
| 4,878,600 | A | 11/1989 | Derby | |
| 4,903,859 | A | 2/1990 | Derby et al. | |
| 4,909,410 | A | 3/1990 | Derby et al. | |
| 4,917,266 | A | 4/1990 | Kellenberger et al. | |
| 4,941,754 | A * | 7/1990 | Murdock | 383/3 |
| 4,948,265 | A | 8/1990 | Futerman | |
| 4,981,391 | A * | 1/1991 | Klementovich | 405/52 |

(Continued)

FOREIGN PATENT DOCUMENTS

JP 3293417 12/1991

(Continued)

*Primary Examiner* — Tony G Soohoo
(74) *Attorney, Agent, or Firm* — Gardner Groff Greenwald & Villanueva

(57) ABSTRACT

A device and method for residual concrete collection for disposal or reclamation of same, wherein a bag is formed, generally prismatic in structure, with an opening in the top. Suspension straps serve to attach the bag and support it below the outflow of concrete mixing or delivery equipment such that concrete and/or water will flow into the device, wherein water will subsequently pass therethrough. The device and collected concrete can then be moved and/or stored for disposal or reclamation of the concrete.

21 Claims, 12 Drawing Sheets

U.S. PATENT DOCUMENTS 5,076,710 A 12/1991 Derby
5,158,367 A 10/1992 Derby
5,158,369 A 10/1992 Derby
5,165,802 A 11/1992 Derby
5,203,633 A 4/1993 Derby
5,230,689 A 7/1993 Derby
5,244,281 A 9/1993 Wiliamson et al.
5,314,250 A * 5/1994 Lee ..... 383/3
5,339,872 A 8/1994 Marino
5,344,048 A * 9/1994 Bonerb ..... 222/105
5,406,966 A 4/1995 Lepkowski et al.
5,490,828 A 2/1996 Derby
5,503,517 A 4/1996 Derby
5,575,426 A 11/1996 Tanii
5,607,237 A 3/1997 LaFleur
5,618,113 A 4/1997 Derby
5,618,254 A 4/1997 Derby
5,618,255 A 4/1997 Nickell et al.
5,649,767 A 7/1997 Nickell et al.
5,685,978 A 11/1997 Petrick et al.
5,738,619 A 4/1998 Nattrass
5,741,065 A 4/1998 Bell et al.
5,752,908 A 5/1998 Derby
5,759,144 A 6/1998 Derby
5,865,541 A * 2/1999 Lafleur ..... 383/120
5,924,796 A 7/1999 Derby
5,984,850 A 11/1999 Derby
5,988,427 A * 11/1999 Moore ..... 220/571
6,019,243 A * 2/2000 Marino ..... 220/573
6,039,468 A 3/2000 Kowalcyzk
6,056,440 A 5/2000 Nattrass
6,063,270 A 5/2000 d'Offay
6,155,277 A 12/2000 Barry
6,179,467 B1 1/2001 Derby et al.
6,196,719 B1 3/2001 Brown
6,207,592 B1 3/2001 Nickell
6,220,755 B1 4/2001 Brown et al.
6,224,260 B1 5/2001 Nickell et al.
6,234,351 B1 * 5/2001 Wilcox ..... 222/95
6,244,443 B1 6/2001 Nickell et al.
6,299,354 B2 10/2001 Nickell et al.
6,302,584 B1 10/2001 Derby et al.
6,334,953 B1 1/2002 Singleton
6,354,439 B1 3/2002 Arbore
6,413,036 B2 * 7/2002 Welton ..... 414/812
6,435,581 B1 8/2002 House et al.
6,461,098 B1 10/2002 Elefsrud
6,467,955 B1 10/2002 Kim
6,742,930 B2 * 6/2004 Matias ..... 383/105
6,866,073 B1 3/2005 Meixelsperger et al.
6,953,277 B2 * 10/2005 Karslake et al. ..... 366/130
2001/0000640 A1 * 5/2001 Welton ..... 298/1 B
2003/0070980 A1 * 4/2003 Ray ..... 210/489
2004/0072928 A1 * 4/2004 Lane et al. ..... 524/47
2004/0105741 A1 * 6/2004 Inglese ..... 414/404
2004/0124190 A1 * 7/2004 Beyer ..... 220/1.5
2008/0251471 A1 * 10/2008 Inglese ..... 210/800

FOREIGN PATENT DOCUMENTS

JP 2002045898 2/2002
WO 0179095 10/2001

* cited by examiner

WET (PLASTIC) AND DRY CONCRETE DISPOSAL DEVICE

CROSS-REFERENCES TO RELATED APPLICATIONS

This application is a divisional of U.S. patent application Ser. No. 10/722,153, filed Nov. 25, 2003 and entitled "Wet (Plastic) And Dry Concrete Reclamation/Disposal Device", which claims priority to U.S. Provisional Patent Application Ser. No. 60/486,961, filed Jul. 14, 2003 and entitled "Wet (Plastic) And Dry Concrete Reclamation/Disposal Device." The disclosures of application Ser. Nos. 10/722,153 and 60/486,961 are incorporated herein in their entireties for all purposes.

TECHNICAL FIELD

The present invention relates generally to concrete handling equipment, and more specifically to an apparatus and method for cleaning or purging of concrete mixing, holding and pumping equipment, and reclamation or disposal of the residual concrete and like materials obtained thereby.

BACKGROUND OF THE INVENTION

There are various types of equipment that handle concrete at a job site. Among these are the mixer, typically a hopper with agitator, wherein concrete, grout and/or primers are kept fluid and then pumped or gravity-fed to the point-of-use or to other equipment that will be utilized to feed the concrete to the point-of-use. The hopper/agitator generally includes screws or blades to facilitate such fluidizing. Concrete ready mix trucks are another piece of equipment that handle the mixing and delivery of concrete, wherein the concrete is mixed with water through rotation of a barrel and internal blades or screws.

Once mixed, concrete is generally delivered to the point-of-use. Delivery may be accomplished via the hopper or ready mix trucks as described above, or via the use of a conveyor or hose. Concrete delivered via flexible hoses or metal pipe from a pump located on a trailer or boom pump. Concrete may also be pumped to a deck placer, which has an extension boom and framework that can be transported to support locations within a building undergoing construction, for placement at a specific point on a roof or floor deck.

Most concrete mixing and handling equipment require cleaning for purposes of maintaining useable life of the equipment and for removal of residual set and unset product. Set concrete will interfere with the operation of equipment and the delivery of the concrete product by restricting and impeding movement of the flowable concrete through the equipment. Thus, it is necessary to rinse unset concrete out of the equipment prior to the setting or hardening of the concrete because, once hardened or set, concrete is extremely difficult to remove.

When rinsing the concrete out, an excess amount of water is typically used to carry out the residual concrete and leave the equipment clean. Since concrete mixing and applying equipment is located at a construction site, there is often little or no containment for materials that are discharged either deliberately through cleaning or through spillage. Thus, some means to provide for containment of the concrete and water while being mixed or during cleaning is critical. Once the concrete has been contained in a storage device, it will set and harden. Excess concrete can be reclaimed in this manner for disposal or recycling of its component materials.

Additionally, due to environmental concerns, concrete can no longer be flushed out of ready mix trucks or pumps onto vacant land. The water used for cleaning concrete off tools and equipment may no longer run into storm sewer systems. The responsibility of cleanup and removal of this concrete falls on the ready mix supplier and/or the pump service company.

In addition to cleaning, many concrete delivery methods require the priming of the system. In this operation, the interior walls of the hose or pipe must be coated with a substance that encourages the concrete to flow to the delivery point. A priming agent consists of grout (sand, cement and water), and/or a specialized lubricant. It is usually undesirable for this priming agent to be allowed to enter the concrete pour, as its characteristics differ from the concrete to be applied. This material requires a containment apparatus to collect it, as it comes out of the tip-hose prior to the onset of actual concrete pumping. Currently, this prime is collected in jury-rigged apparatus or forms made by each contractor.

Although various devices and methods for disposal or recycling of residual concrete are known, all are disadvantageous when compared to the present invention.

For instance, U.S. Pat. No. 3,805,535 to Van Weele teaches a method of forming a concrete post in a hole in the ground by placing a bag of water-permeable flexible material designed to block concrete and retain it in the bag. Such a method presents disadvantages, as the concrete remains in the ground and is not recycled.

U.S. Pat. No. 4,016,978 to Danna, Jr. teaches a concrete mixer apparatus for separation and reclamation of gravel, stones, pebbles and the like, from the concrete mixer by suspending the residual concrete in an excess of water with settling of the adjunct materials. However, such a method is disadvantageous, as the aggregates only are reclaimed and the concrete is not, it is water intensive and must be located next to a large batch plant where ready mix trucks return the unused portion of the order.

U.S. Pat. No. 4,154,671 to Borges, U.S. Pat. No. 6,354,439 to Arbore, U.S. Pat. No. 6,155,277 to Barry and U.S. Pat. No. 5,685,978 to Petrick et al. teach the use of screens or strainers to recover cement/concrete and/or aggregates left in concrete mixing and delivery trucks. However, due to the use of such screens to separate the solid materials, these methods are disadvantageous in that they require separate and additional apparatus for transportation of the concrete to be reclaimed or discarded.

U.S. Pat. No. 5,741,065 to Bell et al. and U.S. Pat. No. 6,039,468 to Kowalcyk teach a cleaning system for concrete mixing trucks, wherein the concrete is recycled on-board and, thus, the concrete trucks are highly specialized and disadvantageous in being unable to handle waste from other standard trucks used in the field.

While some or all of the above-referenced patents may well be utilized for reclamation of residual concrete, they do not adequately provide an on-site containment vessel without requiring a large volume for storage of unfilled, heavy and overly complicated rigid vessels. Accordingly, a device and method of containment and reclamation of concrete and related materials is desirable.

BRIEF SUMMARY OF THE INVENTION

The present invention began out of a need for a device to contain and hold excess concrete, waste primers, and the like at construction job sites and to allow for the convenient disposal or reclamation of the materials so captured.

The present invention is suitable for use as a container for the recovery, disposal, and reclamation of concrete, waste primers, and the like. The invention is a preferably box-shaped structure with suspension straps that can be attached to any of the various forms of construction equipment used in the mixing, application, or installation of concrete or other cementitious products.

Briefly described, in a preferred embodiment, the present invention overcomes the above-mentioned disadvantages and meets the recognized need for such a device by providing a method and apparatus for receipt and retention of waste concrete material at a construction site via lightweight and collapsible containers that do not take up a large volume.

According to its major aspects and broadly stated, the present invention in its preferred embodiment is a bag constructed of woven polypropylene having a top opening for receipt of waste concrete therethrough.

More specifically, the present invention is bag-like device that allows water to weep through its containment surface and, thus, reduce the weight of concrete material to be recycled. For those applications where all the material, including water, must be removed, the present invention utilizes a water impermeable bag or liner as an alternative. This is most typical when waste material occurs on a deck of a building, where water run-off would be unsuitable.

The present invention relates to a device that could be used to collect the discharge of concrete, grout or primer from a concrete ready mix truck, a boom hose, a conveyor, a deck placer, a hopper, or the like. A further embodiment describes a bag that could serve as a containment area under a truck or other concrete applying or mixing apparatus.

Accordingly, a feature and advantage of the present invention is its ability to be utilized with a variety of concrete mixing and delivery apparatuses.

A further feature and advantage of the present invention is that it is easily transported, of low volume and weight, and is suitable for storage on a concrete delivery or mixing truck for use on an as-needed, on-demand basis.

A feature and advantage of the present invention is that it can be used to contain concrete spills, along with hydraulic and oil spills from equipment, thus preventing environmental contamination.

A further feature and advantage of the present invention is ease of manufacture and low cost of production.

A feature and advantage of the present invention is that it is useful either for reclamation of concrete for recycling, or for convenient transport and disposal thereof.

An additional feature and advantage of the present invention is that it is easily moved within, through and/or atop tall buildings during construction thereof.

A further feature and advantage of the present invention is that it easily accommodates uneven terrain and surfaces attendant construction sites.

These and other features and advantages of the present invention will become more apparent to one skilled in the art from the following description and claims when read in light of the accompanying drawings.

BRIEF DESCRIPTION OF THE DRAWINGS

Figure 1:
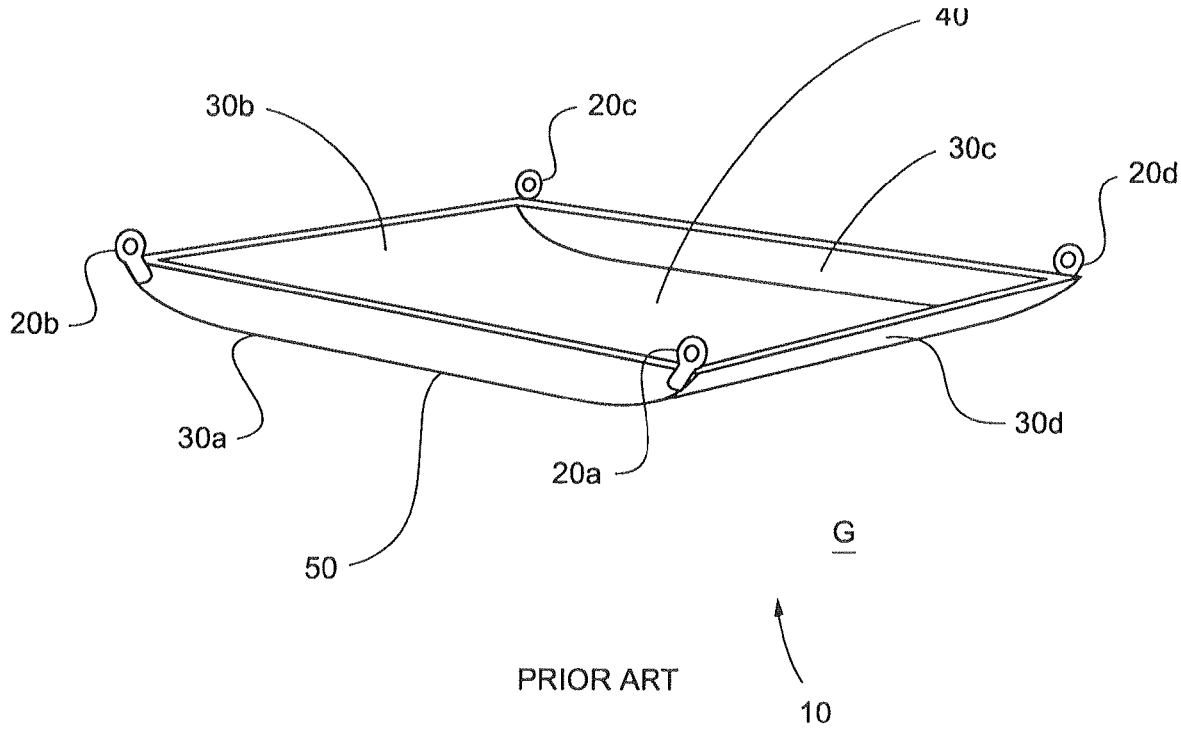
Figure 2:
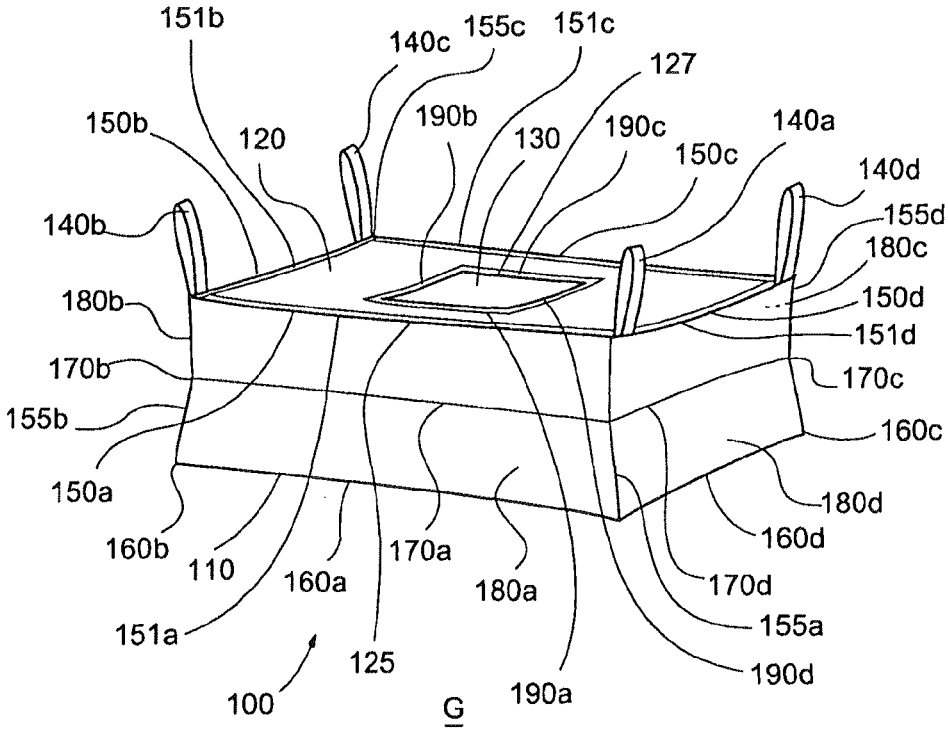
Figure 12:
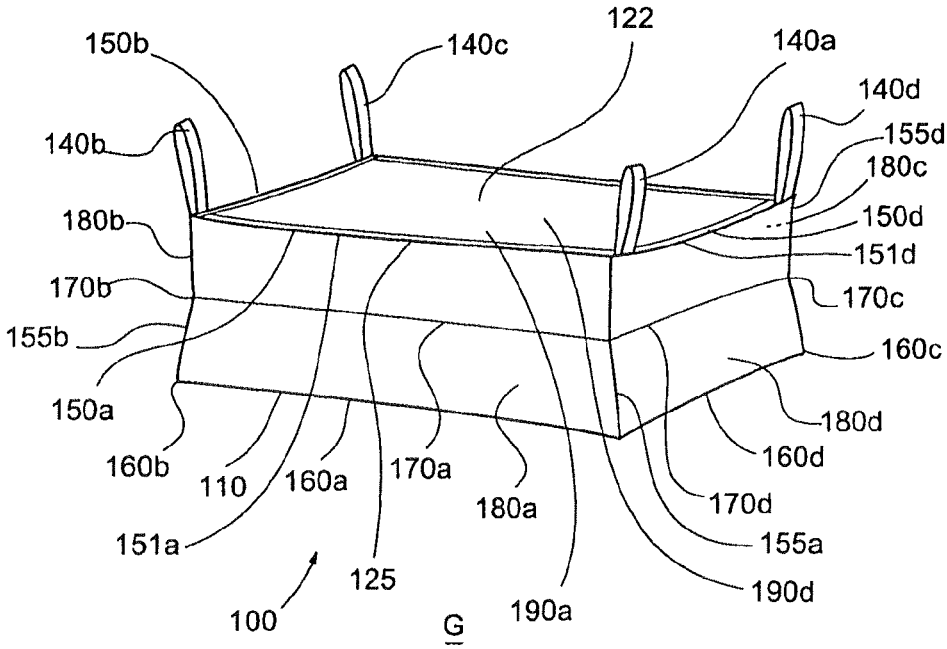
Figure 3:
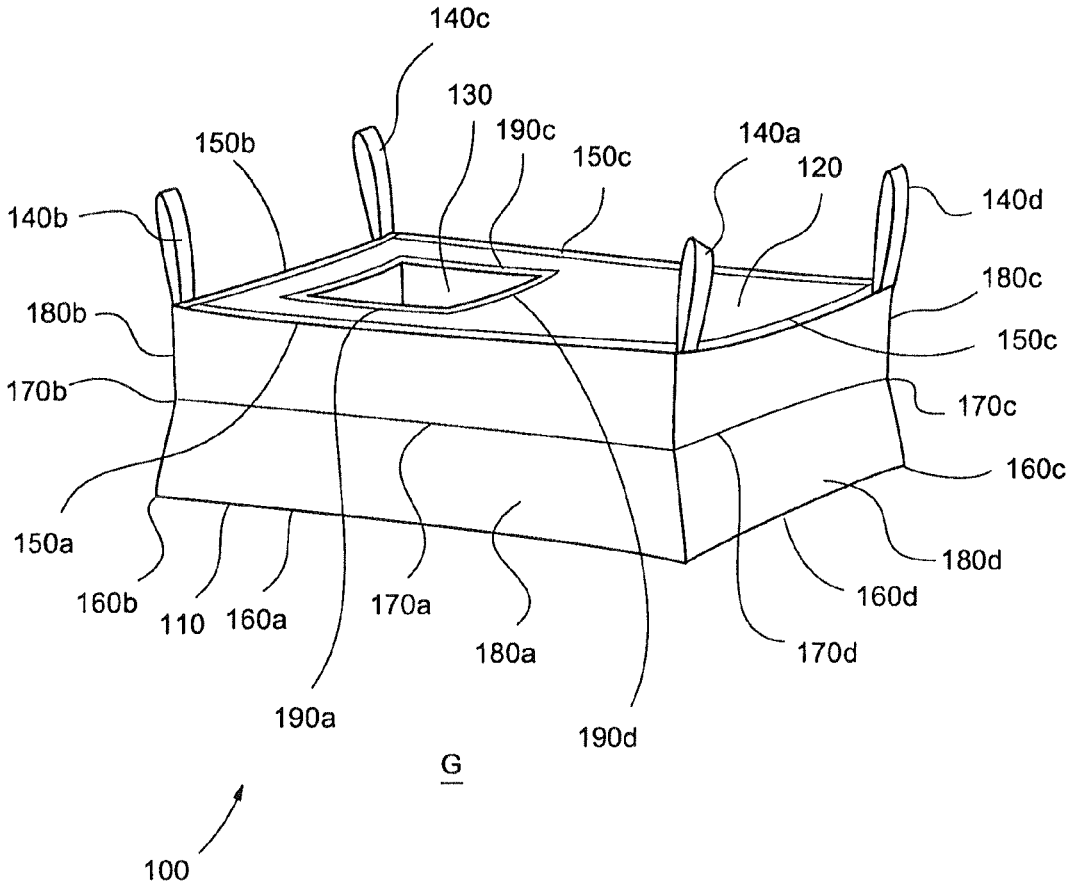
Figure 4:
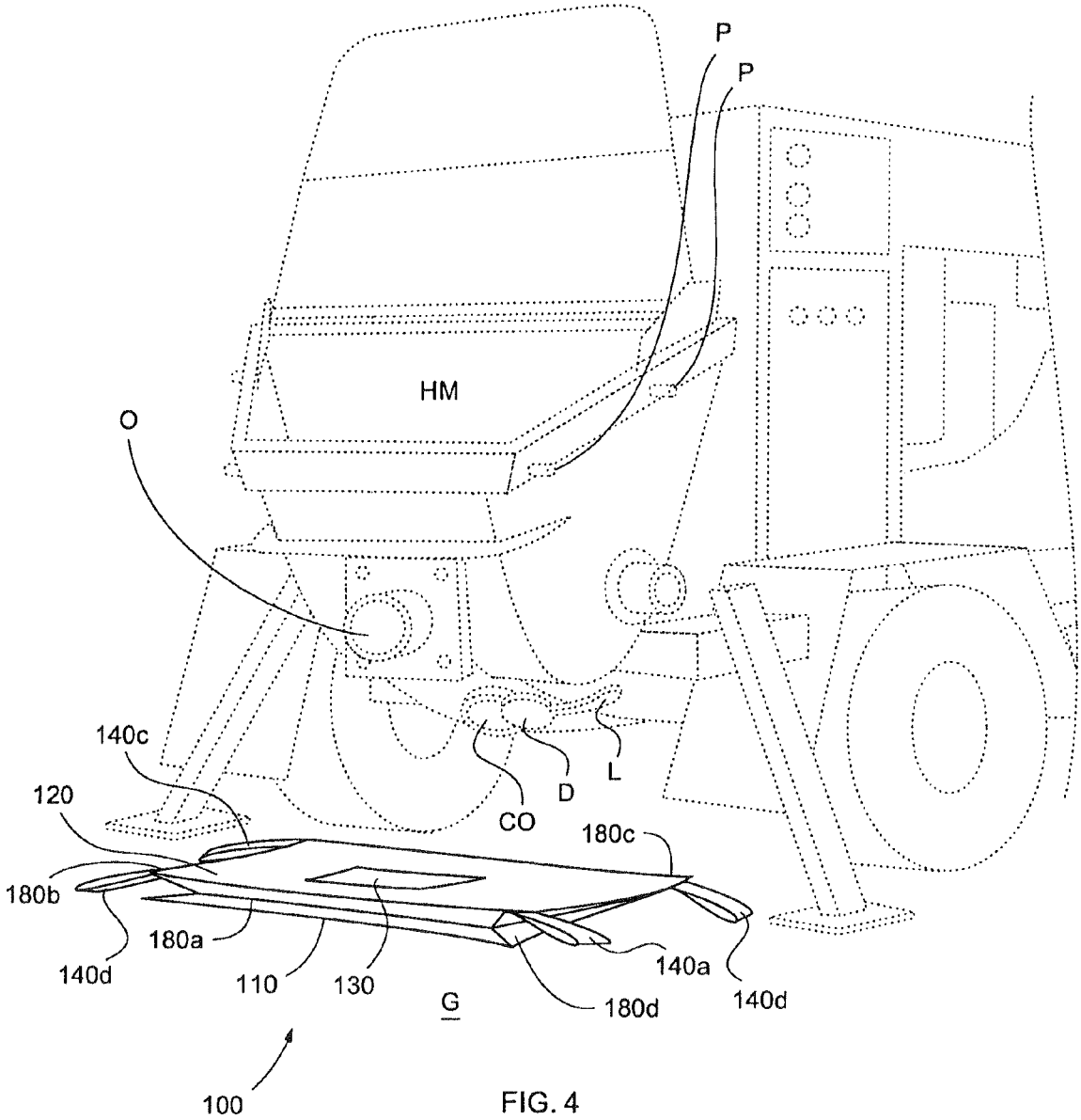
Figure 5:
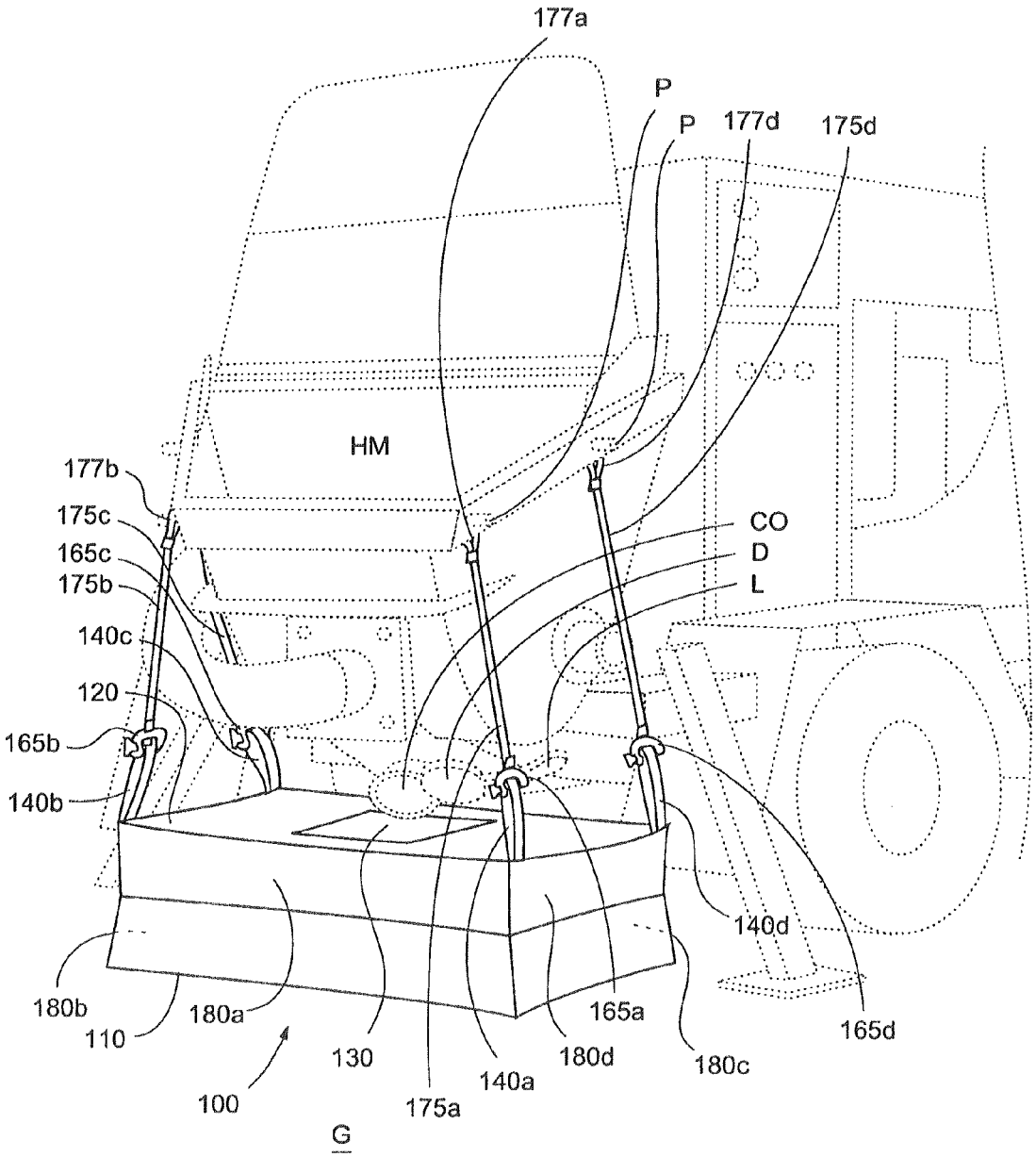
Figure 6:
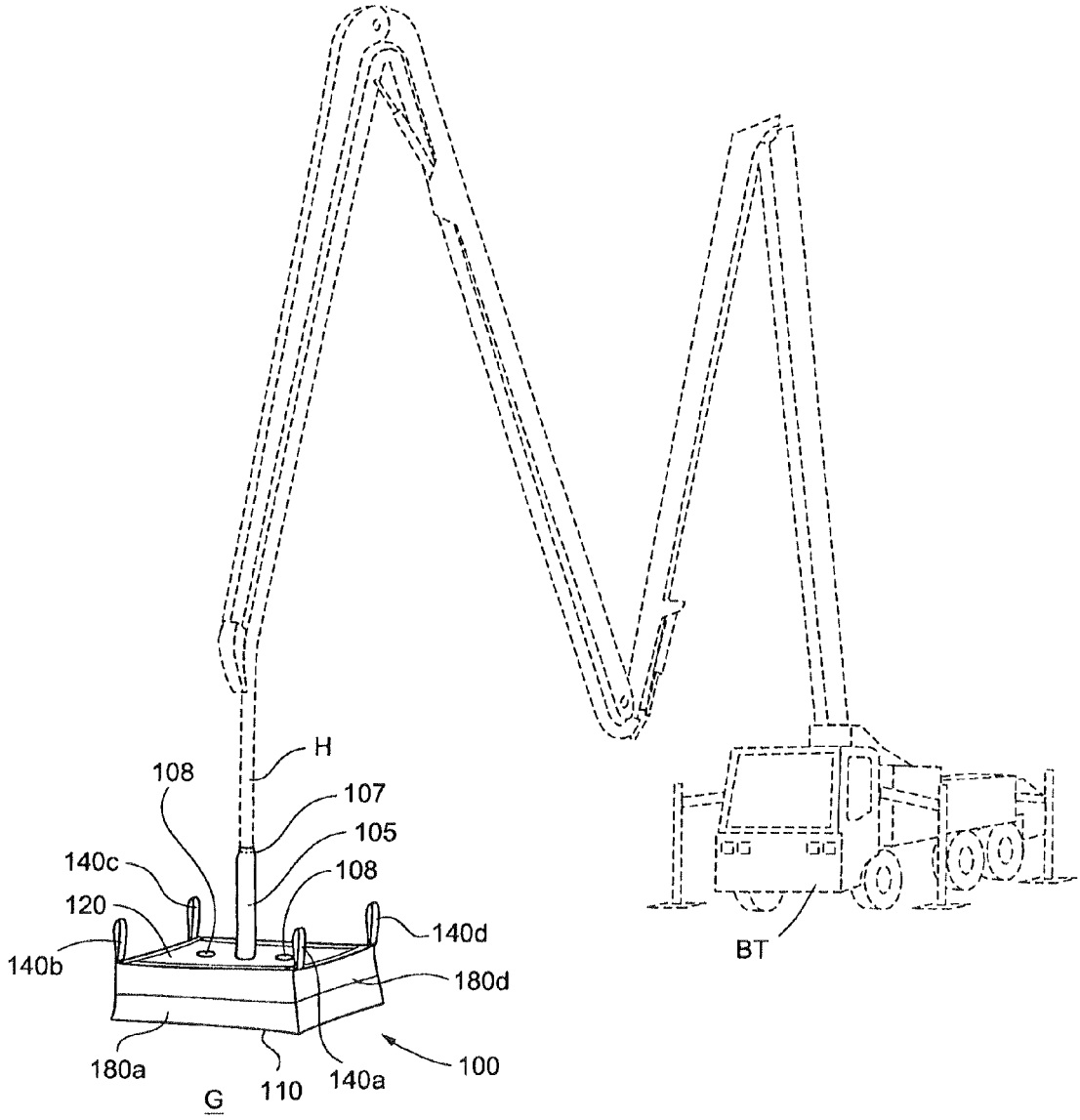
Figure 7:
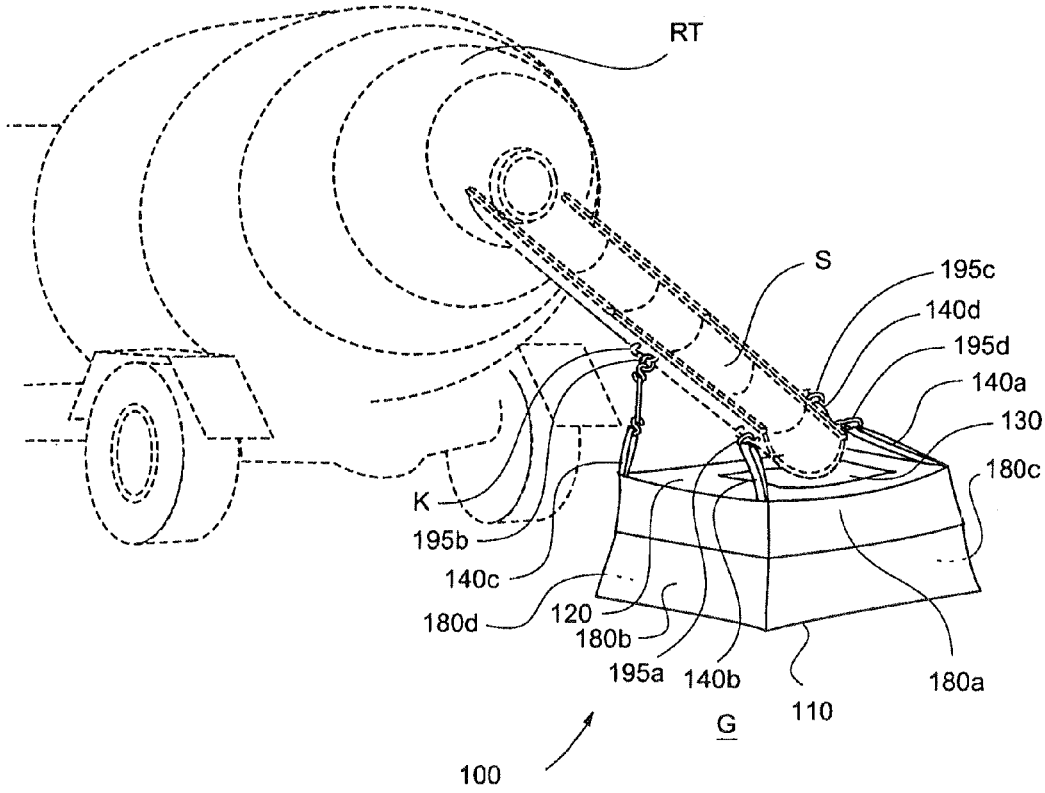
Figure 9:
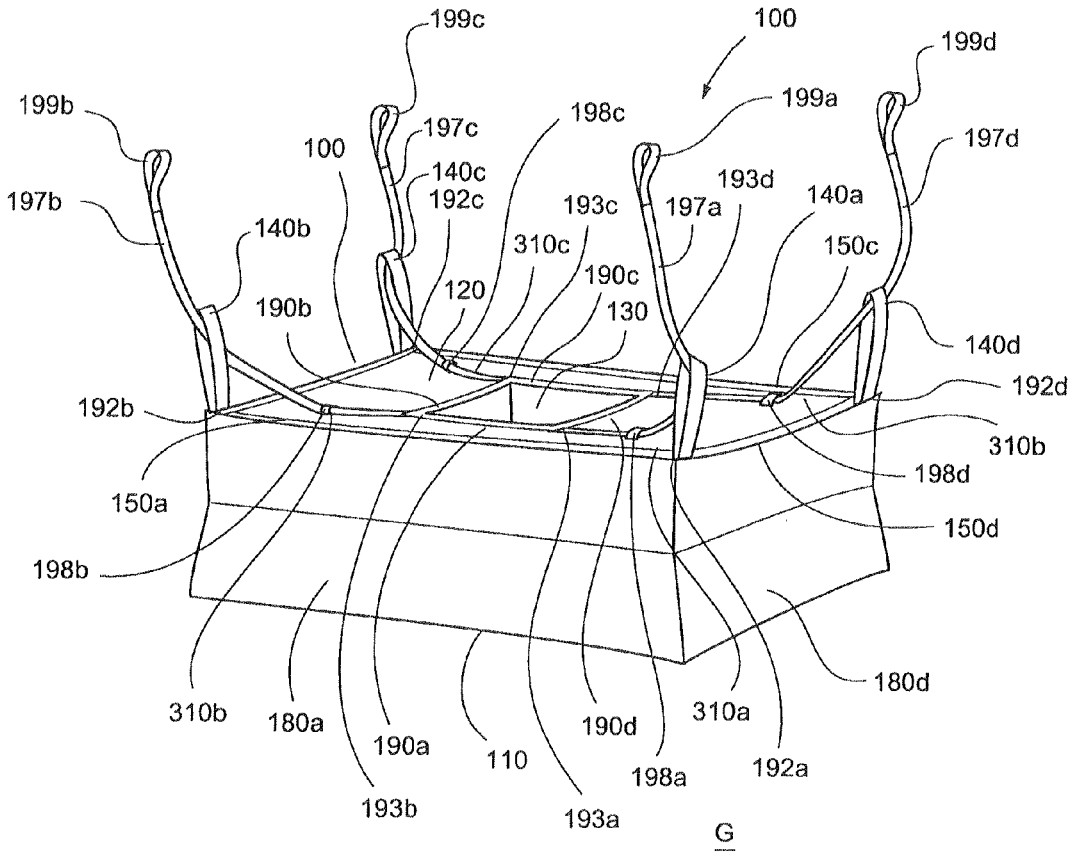
Figure 10:
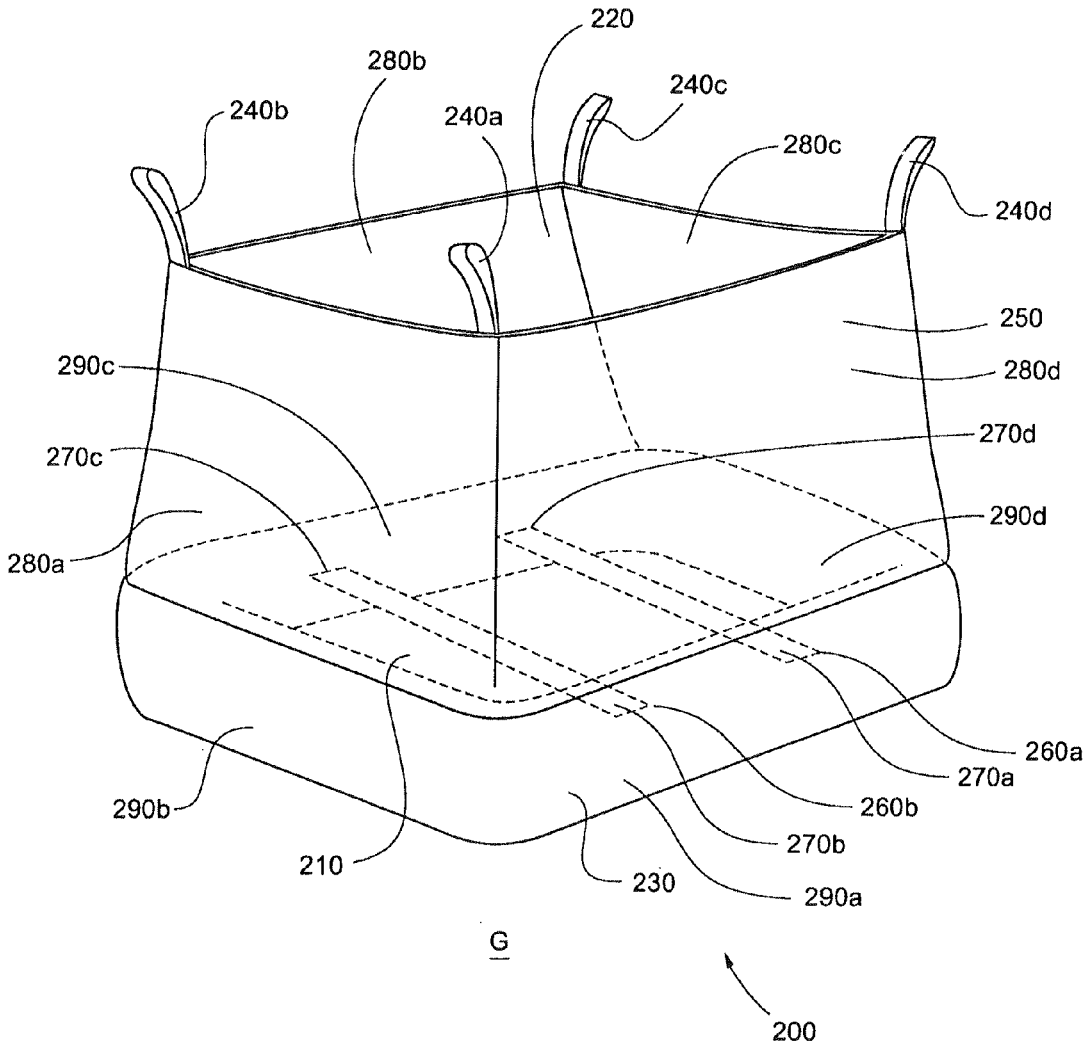
Figure 11:
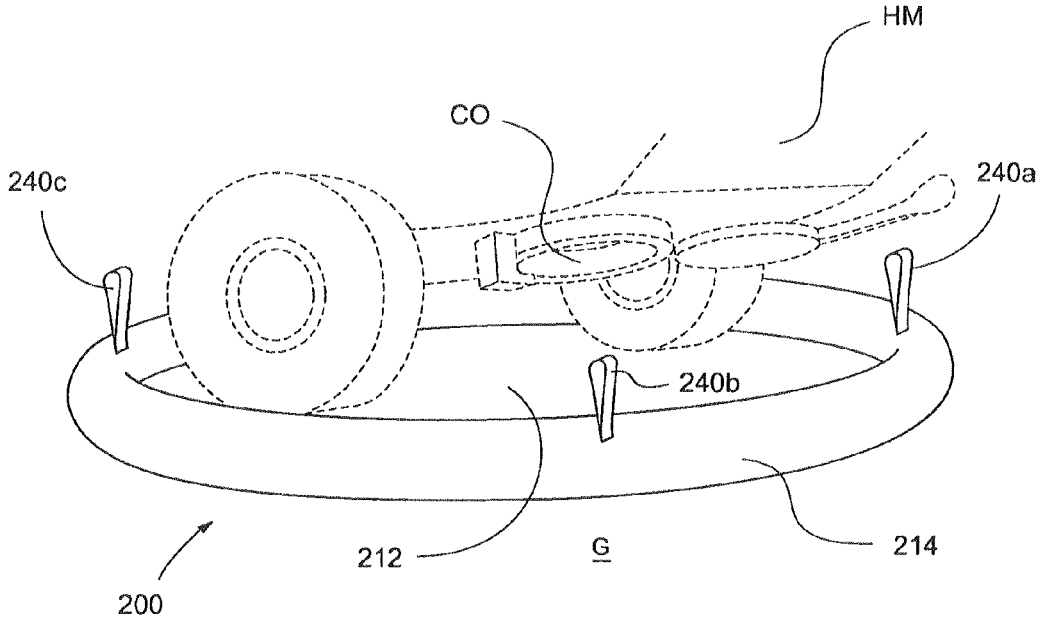
Figure 13:
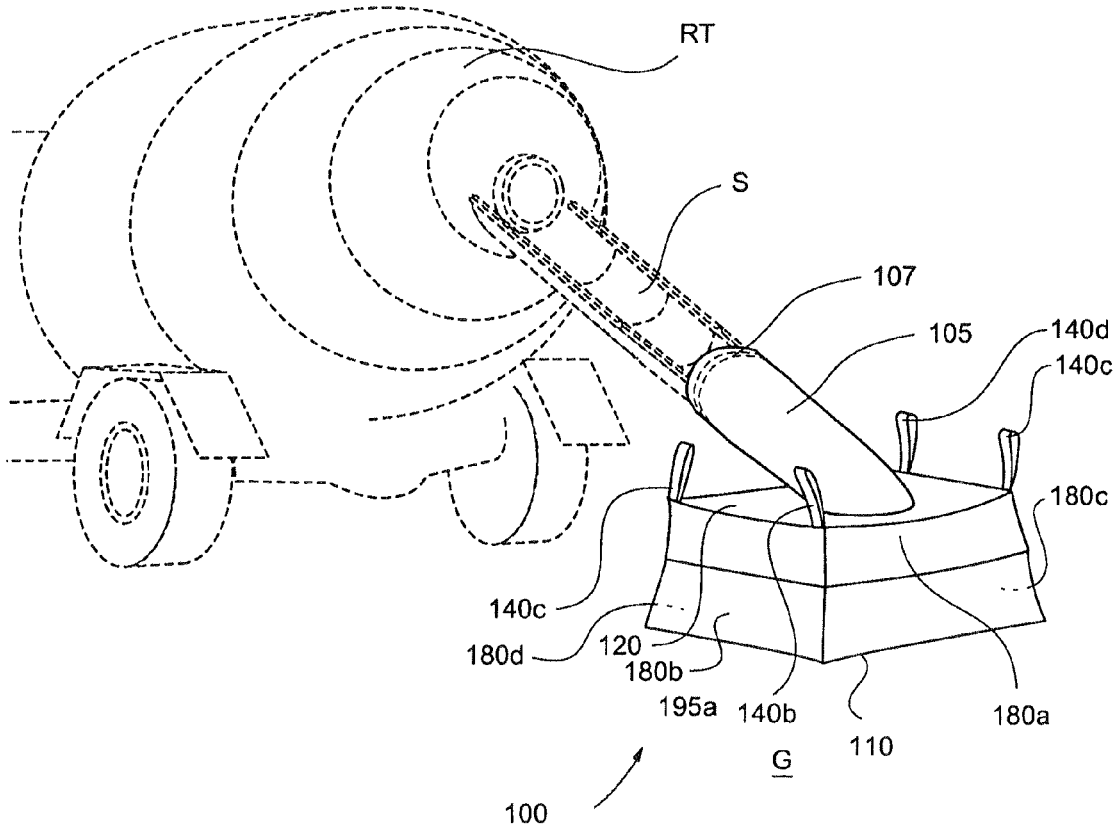

Having thus described the invention in general terms, the present invention will be better understood by reading the Detailed Description of the Preferred and Alternate Embodiments with reference to the accompanying drawing Figures, which are not necessarily drawn to scale, and in which like reference numerals denote similar structures and refer to like elements throughout, and in which:

FIG. 1 is a perspective view of a prior art device;

FIG. 2 is a perspective view of a concrete reclaim and disposal device according to a preferred embodiment of the present invention;

FIG. 3 is a perspective view of a concrete reclaim and disposal device according to an alternate embodiment of the present invention;

FIG. 4 is a perspective view of a concrete reclaim and disposal device according to a preferred embodiment of the present invention shown below a concrete remixing hopper and ready for installation thereon;

FIG. 5 is a perspective view of a concrete reclaim and disposal device according to a preferred embodiment of the present invention depicting the device installed on a concrete remixing hopper;

FIG. 6 is a perspective view of a concrete reclaim and disposal device according to a preferred embodiment of the present invention installed on the outlet of a hose from a boom truck;

FIG. 7 is a perspective view of a concrete reclaim and disposal device according to a preferred embodiment of the present invention shown installed on the chute of a ready mix truck;

FIG. 8 is a perspective view of a concrete reclaim and disposal device according to a preferred embodiment of the present invention shown forming a conical shape around a concrete discharge hose;

FIG. 9 is a perspective view of a concrete reclaim and disposal device according to a preferred embodiment of the present invention having reinforcing strips;

FIG. 10 is a perspective view of a concrete reclaim and disposal device according to an alternate embodiment of the present invention;

FIG. 11 is a perspective view of a concrete reclaim and disposal device according to an alternate embodiment depicted in place under a concrete mixing apparatus;

FIG. 12 is a perspective view of a concrete reclaim and disposal device according to an alternate embodiment of the present invention; and, FIG. 13 is a perspective view of a concrete reclaim and disposal device according to an alternate embodiment of the present invention shown installed on the chute of a ready mix truck.

DETAILED DESCRIPTION OF THE PREFERRED AND ALTERNATIVE EMBODIMENTS

In describing the preferred and selected alternate embodiments of the present invention, as illustrated in the Figures, specific terminology is employed for the sake of clarity. The invention, however, is not intended to be limited to the specific terminology so selected, and it is to be understood that each specific element includes all technical equivalents that operate in a similar manner to accomplish similar functions.

The present invention is suitable for use as a concrete reclamation and disposal device and method at construction sites, wherein the device of the present invention can be easily transported due to its light weight and low collapsed volume.

FIG. 1 shows prior art device 10 utilized for containing residual concrete and concrete-like materials. Prior-art device 10 is a heavy metal, fiberglass or wood shell 50 having support hooks 20*a*, 20*b*, 20*c* and 20*d* for lifting and moving. Prior-art device 10 rests on ground G. Residual concrete is allowed to fall by gravity or pumping into bottom 40 of prior-art device 10. Concrete is retained by walls 30*a*, 30*b*, 30*c* and 30*d*, wherein walls 30*a*, 30*b*, 30*c* and 30*d* form a perimeter preventing leakage of concrete from prior-art device 10. Upon completion of filling prior-art device 10, it may be moved by heavy equipment to trucks that can then return it, along with the concrete within it, for disposal or recycling. Prior-art device 10 is large, heavy and rigid, takes up substantial space within a delivery truck, and adds significantly to the weight to be transported to and from a construction site when utilized for reclamation of concrete.

Referring now to FIG. 2, apparatus 100 overcomes the disadvantages of previous equipment, such as, for exemplary purposes only, prior-art device 10. Apparatus 100 preferably has a prismatic shape preferably defined by first side 180*a*, second side 180*b*, third side 180*c* and fourth side 180*d*, top 120 and bottom 110, which preferably rests on ground G. The respective heights of first side 180*a*, second side 180*b*, third side 180*c* and fourth side 180*d* are preferably less than or equal to their respective lengths. Opening 130 is preferably centrally formed through top 120 and preferably provides access to the interior of apparatus 100. Straps 140*a*, 140*b*, 140*c* and 140*d* are preferably attached at edges 155*a*, 155*b*, 155*c* and 155*d*, preferably formed between sides 180*a*, 180*b*, 180*c* and 180*d*, such that apparatus 100 may preferably be suspended by attachment of straps 140*a*, 140*b*, 140*c* and 140*d* preferably over posts or hooks located on equipment for mixing, re-mixing or delivery of concrete, or by extension straps located between the equipment and straps 140. Apparatus 100 is preferably constructed from woven polypropylene and/or any other suitable material, such as, for exemplary purposes only, polyolefins, nylon, and other polymers. In particular, the material chosen must preferably possess sufficient porosity to permit water seepage or weepage therethrough, yet preferably retain concrete pieces and/or particles within the bag. The material must be strong enough to prevent puncture and tearing, and must allow lifting and transport of the concrete-laden device.

Apparatus 100 overcomes the disadvantages of previous equipment, such as prior-art device 10, by preferably being made of lightweight material and by preferably being collapsible. Apparatus 100 preferably has first side 180*a*, second side 180*b*, third side 180*c* and fourth side 180*d*. First side 180*a* preferably has top edge 150*a*, side edge 155*a*, side edge 155*b*, and bottom edge 160*a*, wherein top edge 150*a* and bottom edge 160*a* are preferably of equal or greater dimension than side edge 155*a* and side edge 155*b*. Second side 180*b* preferably has top edge 150*b*, side edge 155*b*, side edge 155*c*, and bottom edge 160*b*, wherein top edge 150*b* and bottom edge 160*b* are preferably of equal or greater dimension than side edge 155*b* and side edge 155*c*. Third side 180*c* preferably has top edge 150*c*, side edge 155*c*, side edge 155*d*, and bottom edge 160*c*, wherein top edge 150*c* and bottom edge 160*c* are preferably of equal or greater dimension than side edge 155*c* and side edge 155*d*. Fourth side 180*d* preferably has top edge 150*d*, side edge 155*d*, side edge 155*a*, and bottom edge 160*d*, wherein top edge 150*d* and bottom edge 160*d* are preferably of equal or greater dimension than side edge 155*d* and side edge 155*a*. First side 180*a* is preferably attached to second side 180*b* at edge 155*b*. Second side 180*b* is preferably attached to third side 180*c* at edge 155*c*. Third side 180*c* is preferably attached to fourth side 180*d* at edge 155*d*. Fourth side 180*d* is preferably attached to first side 180*a* at edge 155*a*.

Preferably located along periphery 125 formed by sides 180*a*, 180*b*, 180*c* and 180*d* are preferably top edges 150*a*, 150*b*, 150*c* and 150*d*, respectively, wherein top edges 150*a*, 150*b*, 150*c* and 150*d* preferably comprise reinforcement strips 151*a*, 151*b*, 151*c* and 151*d*, respectively. Additionally, reinforcement strips 190*a*, 190*b*, 190*c* and 190*d*, are preferably located around the periphery 127 of hole 130.

Preferably located within sides 180*a*, 180*b*, 180*c* and 180*d* of apparatus 100 are corresponding fold lines 170*a*, 170*b*, 170*c* and 170*d*. Apparatus 100 may preferably be collapsed by folding along lines 170*a*, 170*b*, 170*c* and 170*d*, such that lines 170*a*, 170*b*, 170*c* and 170*d* are folded in towards each other and first top edge 150*a* is preferably brought into proximity to first bottom edge 160*a*, second top edge 150*b* is preferably brought into proximity to second bottom edge 160*b*, third top edge 150*c* is preferably brought into proximity to third bottom edge 160*c*, and fourth top edge 150*d* is preferably brought into proximity to fourth bottom edge 160*d*. In such a fashion, apparatus 100 is preferably in collapsed form and consumes very little space on, or folded and placed in the cab of, a transport vehicle. When it is desired to utilize apparatus 100, apparatus 100 is opened and expanded. Upon attaching straps 140*a*, 140*b*, 140*c* and 140*d* to equipment posts or hooks, apparatus 100 can be raised to any desired height, but preferably is positioned such that bottom 110 is retained on ground G.

Referring now to FIG. 3, an alternative embodiment is shown. This alternative embodiment is substantially similar in construction and material choice to the embodiment of FIG. 2, except as provided herein. Apparatus 100 has opening 130 located in top 120, such that opening 130 is located off-center within top 120. By positioning opening 130 off-center, apparatus 100 may now be suspended under mixing or delivery equipment having a spout or other opening located away from the central support, wherein the central support can still be provided to apparatus 100 by suspension via straps 140*a*, 140*b*, 140*c* and 140*d*.

Referring now to FIG. 4, a hopper/agitator HM is shown, wherein apparatus 100 is shown preparatory to installation while still in collapsed form on ground G. Opening 130 of apparatus 100 will preferably be installed either under clean-out CO or on outlet O of hopper/agitator HM, such that concrete emitting from outlet O or clean-out CO, after opening door D via handle L, will preferably fall into opening 130 and preferably be contained within apparatus 100.

FIG. 5 shows apparatus 100 now raised, expanded and preferably installed under clean-out CO of hopper/agitator HM, after opening door D via handle L, wherein straps 140*a*, 140*b*, 140*c* and 140*d* of apparatus 100 are preferably attached over posts P of hopper/agitator HM in order to preferably suspend apparatus 100 under hopper/agitator HM such that concrete, either residual or mixed with wash water, will preferably fall through outlet O and into apparatus 100 via opening 130 in top 120.

Apparatus 100 is preferably attached and held in place via support mounts 175*a*, 175*b*, 175*c* and 175*d*, wherein support mounts 175*a*, 175*b*, 175*c* and 175*d* preferably include loops 177*a*, 177*b*, 177*c* (occluded in drawing) and 177*d*, respectively formed therein. Support mounts 175*a*, 175*b*, 175*c* and 175*d* are preferably attached to straps 140*a*, 140*b*, 140*c* and 140*d* of apparatus 100, preferably via carabiners or devises 165*a*, 165*b*, 165*c* and 165*d*, respectively, or the like. Having been so attached, support mounts 175*a*, 175*b*, 175*c* and 175*d* are then preferably installed over posts P of hopper/agitator HM preferably by sliding loops 177*a*, 177*b*, 177*c* (occluded in drawing) and 177*d* over posts P. In such a fashion, apparatus 100 is preferably expanded and held in place below outlet O so that concrete and/or water will fall into apparatus 100 and be contained therein. Alternatively, loops 177 may be attached directly to posts P via carabiners, devises, or the like.

FIG. 6 shows apparatus 100 preferably installed over the tip hose H of a boom pump truck BT, such that when residual concrete is pumped out of hose H, it preferably passes through tube 105 into apparatus 100, which is placed on ground G in a suitable location. Tube 105 is held in place on tip hose H by removable fastening means 107, such as, for exemplary purposes only, hook-and-loop fasteners.

During the discharge of concrete into apparatus 100, excess pressure will be vented through holes 108 in top 120. Apparatus 100 may be supported and/or transported by means of straps 140*a*, 140*b*, 140*c* and 140*d*.

FIG. 7 depicts an alternate embodiment of apparatus 100 installed under chute S of a ready mix truck RT, such that residual concrete material will fall into apparatus 100 via opening 130 in top 120, wherein opening 130 is offset from the center of top 120, and wherein chute S of ready mix truck RT is located to the side of the centerline of ready mix truck RT. Apparatus 100 is secured under chute S of ready mix truck RT by use of straps 140*a*, 140*b*, 140*c* and 140*d*, wherein straps 140*a*, 140*b*, 140*c* and 140*d* include carabiners 195*a*, 195*b*, 195*c* and 195*d* located thereon, and wherein carabiners 195*a*, 195*b*, 195*c* and 195*d* attach to hooks or rings K on spout S of ready mix truck RT.

Figure 8A:
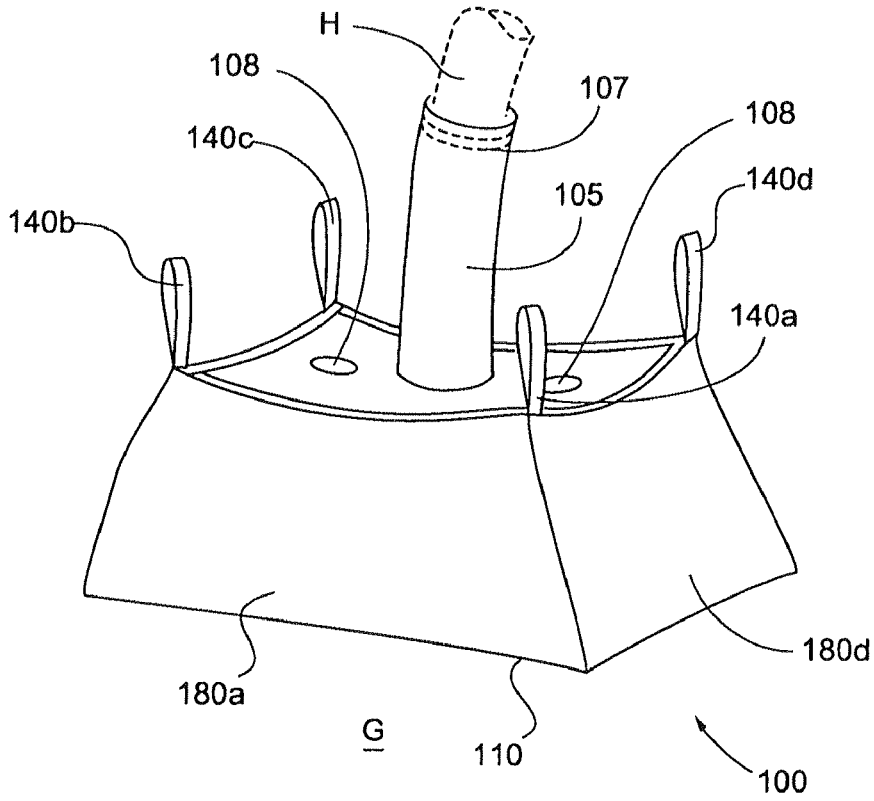

Referring now to FIG. 8A, in an alternate embodiment of apparatus 100, tube 105 of apparatus 100 exits top 120 and can be conformed to generally fit over a hose H, while apparatus rests on ground G. Tube 105 may be secured by fastening means 107, such as, for exemplary purposes only hook-and-loop fasteners. Straps 140*a*, 140*b*, 140*c* and 140*d* may be used to support apparatus 100 and may be used for lifting for transport. During the discharge of concrete into apparatus 100, excess pressure will be vented through holes 108 in top 120.

Figure 8B:
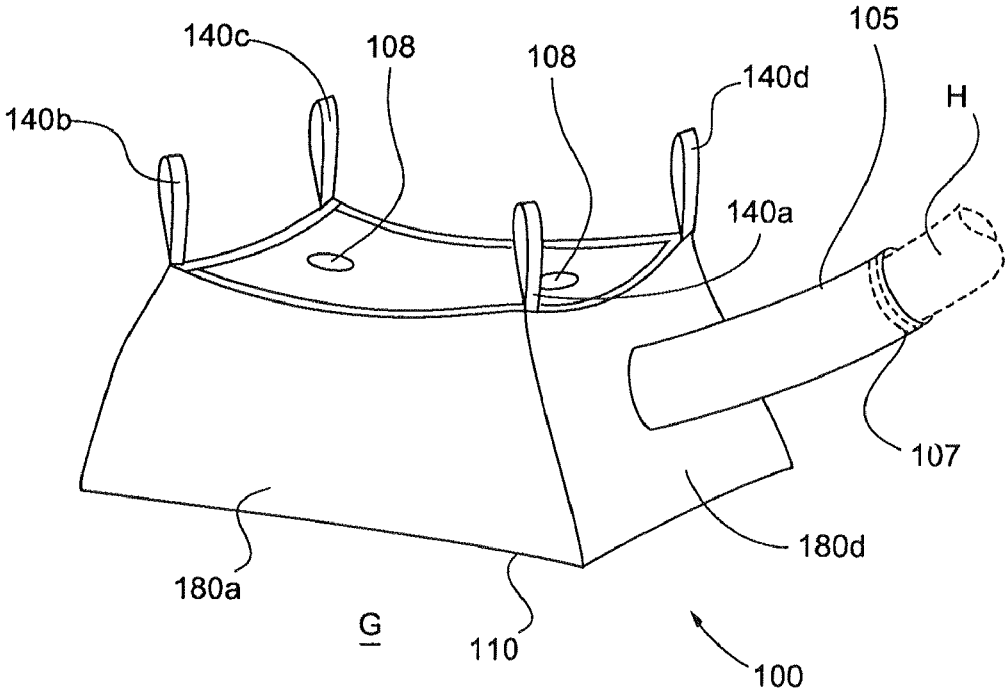

In an alternate embodiment shown in FIG. 8B, for use in locations having inadequate vertical space above apparatus 100, tube 105 of apparatus 100 exits side 180*d*, and can be conformed to generally fit over a hose H, while apparatus rests on ground G. Tube 105 may be secured by fastening means 107, such as, for exemplary purposes only hook-and-loop fasteners. Straps 140*a*, 140*b*, 140*c* and 140*d* may be used to support apparatus 100 and may be used for lifting for transport. During the discharge of concrete into apparatus 100, excess pressure will be vented through holes 108 in top 120.

Referring now to FIG. 9, in an alternate embodiment, apparatus 100 has formed therein opening 130 in top 120, where reinforcing strips 310*a*, 310*b*, 310*c* and 310*d* are located between the corners 192*a*, 192*b*, 192*c* and 192*d* of top 120 and the corners 193*a*, 193*b*, 193*c* and 193*d* of opening 130, so as to strengthen opening 130 to permit retention of its shape once concrete has entered apparatus 100 and place tension on walls 180*a*, 180*b*, 180*c* and 180*d* thereof. More specifically, corner 192*a* is located at the juncture of top edges 150*a* and 150*b* of sides 180*a* and 180*b*, respectively. Corner 192*b* is located at the juncture of top edges 150*b* and 150*c* of sides 180*b* and 180*c*, respectively. Corner 192*c* is located at the juncture of top edges 150*c* and 150*d* of sides 180*c* and 180*d*, respectively. Corner 192*d* is located at the juncture of top edges 150*d* and 150*a* of sides 180*d* and 180*a*, respectively. Corner 193*a* is located at the juncture of reinforcing strip 190*a* with reinforcing strip 190*b*. Corner 193*b* is located at the juncture of reinforcing strip 190*b* and reinforcing strip 190*c*. Corner 193*c* is located at the juncture of reinforcing strip 190*c* and reinforcing strip 190*d*. Corner 193*d* is located at the juncture of reinforcing strip 190*d* and reinforcing strip 190*a*.

While resting on ground G, apparatus 100 may be held in place under a discharge clean-out or chute via belts 197*a*, 197*b*, 197*c* and 197*d*. Belts 197*a*, 197*b*, 197*c* and 197*d* are attached to top 120 of apparatus 100 at corners 193*a*, 193*b*, 193*c* and 193*d*, respectively. Belts 197*a*, 197*b*, 197*c* and 197*d* pass through retainers 198*a*, 198*b*, 198*c* and 198*b*, then through straps 140*a*, 140*b*, 140*c* and 140*d*. Belts 197*a*, 197*b*, 197*c* and 197*d* may be secured via belt loops 199*a*, 199*b*, 199*c* and 199*b* to attachment points on a suitable apparatus. Lifting of apparatus 100 may be accomplished by means of straps 140*a*, 140*b*, 140*c* and 140*d*. Alternately apparatus 100 may be lifted by means of attachment belts 197*a*, 197*b*, 197*c* and 197*d* via belt loops 199*a*, 199*b*, 199*c* and 199*d*.

As shown in FIG. 10, in an alternative embodiment, apparatus 200 sits on ground G and includes side walls 280*a*, 280*b*, 280*c* and 280*d* formed therein. Side walls 280*a*, 280*b*, 280*c* and 280*d* form an upper enclosure 250. Lower enclosure 230 is formed by base walls 290*a*, 290*b*, 290*c*, 290*d* and bottom 210, wherein base walls 290*a*, 290*b*, 290*c* and 290*d* of lower enclosure 230 preferably are double-walled and may be inflated with air. Following inflation, side walls 280*a*, 280*b*, 280*c* and 280*d* may be manipulated to extend upward from base walls 290*a*, 290*b*, 290*c* and 290*d*, thus forming an open container having opening 220 therein. In this fashion, base walls 290*a*, 290*b*, 290*c* and 290*d* serve to contain any residual concrete and/or water therein, while side walls 280*a*, 280*b*, 280*c* and 280*d* help to contain the residual concrete and/or water by directing the residual concrete and/or water into base walls 290*a*, 290*b*, 290*c* and 290*d*. Upon setting and/or hardening of the concrete, base walls 290*a*, 290*b*, 290*c* and 290*d* may be deflated for further transportation. Apparatus 200 may be constructed of any suitable material, such as, for exemplary purposes only, woven or film polypropylene. In such an embodiment, apparatus 200 is particularly suited for installation under vehicles or mixing/conveying apparatuses as is more fully described below, wherein apparatus 200 provides containment for any spillage that might occur during normal operation. Apparatus 200 may be suspended from a vehicle or mixing/conveying apparatus via straps 240*a*, 240*b*, 240*c* and 240*d*, wherein straps 240*a*, 240*b*, 240*c* and 240*d* are located at the tops of the junctures of side walls 280*a*, 280*b*, 280*c* and 280*d*.

Apparatus 200 also may provide anti-sag webs 260*a* and 260*b*, wherein anti-sag webs 260*a* and 260*b* are attached to base walls 290*a* and 290*c*. More specifically, anti-sag web 260*a* attaches to base wall 290*a* at attachment point 270*a* and to base wall 290*c* at attachment point 270*d*. Anti-sag web 260*b* attaches to base wall 290*a* at attachment point 270*b* and to base wall 290*c* at attachment point 270*c*.

FIG. 11 shows apparatus 200 installed under hopper/agitator HM, or similar truck. Concrete that may spill from hopper/agitator or truck HM, or residual concrete that is removed from hopper/agitator or truck HM through clean-out CO, will be contained by apparatus 200, thereby preventing environmental contamination. Apparatus 200 is placed on ground G in the area where the hopper/agitator or truck HM will be stationed. The hopper/agitator or truck HM will then drive onto floor 212 of apparatus 200, such that the discharge area of hopper/agitator HM will be over apparatus 200. Wall 214 is then inflated to contain any material flow preventing it from exiting apparatus 200. Upon completion of operations, wall 214 may be partially deflated and hopper/agitator or truck HM may then drive away, leaving waste contained within apparatus 200. Straps 240*a*, 240*b*, 240*c* and 240*d* (occluded in drawing) may be used to transport apparatus once it is full and solidified, or otherwise no longer needed.

Turning now to FIG. 12, an alternate embodiment of apparatus 100 is shown, wherein top 122 is open. This embodiment is suitable for areas needing a larger entrance for concrete discharge.

FIG. 13 depicts an alternate embodiment of apparatus 100 installed over chute S of a ready mix truck RT, such that residual concrete material will fall into apparatus 100 via opening 130 in top 120, wherein tube 105 is extends from the center of top 120 and covers chute S, wherein chute S of ready mix truck RT discharges from rear of ready mix truck RT. Apparatus 100 is secured over chute S of ready mix truck RT by fastening means 107, such as, for exemplary purposes only, hook-and-loop fasteners. Apparatus may be transported via use of straps 140*a*, 140*b*, 140*c* and 140*d*.

It is envisioned in an alternative embodiment that apparatus 100, 200 may be fabricated from any porous material that would permit water to seep or weep therethrough, yet be strong and puncture resistant enough to function for the uses and purposes provided herein.

It is further envisioned in alternate embodiments that apparatus 100, 200 of the present invention may be made from a water impermeable material; or, may be lined, internally or externally, with a water impermeable material; or, may be chemically treated in order to obtain water impermeable characteristics. This would facilitate the capture of priming agent and the first concrete material to pass out of a pump in areas where it would be undesirable for liquid, including water, to exit the bag.

In still further an alternate embodiment, it is envisioned that apparatus 100 could be attached to a support frame, wherein the frame has attachment points for straps 140*a*, 140*b*, 140*c* and 140*d* of apparatus 100, and wherein the support frame is independent of any other equipment. In such fashion, apparatus 100 would be expanded from its collapsed configuration and straps 140*a*, 140*b*, 140*c* and 140*d* would be attached to the support frame, thereby retaining apparatus 100 open and ready to receive discharge of concrete. The supporting frame could be made from any suitable structural material, such as, for exemplary purposes only, metal, plastic, or wood, and could further include webbing supports. Such an embodiment may have application, for example, when used as a bulk ready mix equipment clean-out receiving station, or the like.

It is also conceived that in an alternate embodiment, straps 140*a*, 140*b*, 140*c* and 140*d* may be bungee-type cords, springs, resilient rubber cords, or the like.

It is further conceived that straps 140*a*, 140*b*, 140*c* and 140*d* could be made of webbing material.

It is still further conceived in an alternate embodiment that apparatus 100 could be generally of round cross-section.

It is still further conceived in an alternate embodiment that apparatus 100 could be of any round-bottomed or generally circular shape, as in, for example, a parachute-like configuration.

It is yet further contemplated in an alternate embodiment that apparatus 100 could be of generally prismatic shape or of generally polygonal cross section.

As has been described with regard to the various embodiments of FIGS. 2-13, the present invention is suitable for use in collection of concrete. Accordingly, in use and operation, a source of concrete to be collected is provided. At least one apparatus 100, 200 for containing concrete to be collected is attached to the source. Apparatus 100, 200 may be supported by the source of concrete to be collected, as by hook-and-loop fasteners, clips, clamps, or the like, or may otherwise be oriented under, proximate, or adjacent to the source of concrete to be collected. The concrete to be collected then is allowed or made to flow into apparatus 100, 200 through an opening therewithin.

Having thus described exemplary embodiments of the present invention, it should be noted by those skilled in the art that the within disclosures are exemplary only, and that various other alternatives, adaptations, and modifications may be made within the scope of the present invention. Many modifications and other embodiments of the invention will come to mind to one skilled in the art to which this invention pertains having the benefit of the teachings presented in the foregoing descriptions and the associated drawing Figures. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

Accordingly, the present invention is not limited to the specific embodiments illustrated herein, but is limited only by the following claims.

What is claimed is:

1. A method of disposition of wet concrete and wash water from concrete handling equipment, said method comprising:

positioning a flexible containment apparatus adjacent a discharge port of the concrete handling equipment, wherein the flexible containment apparatus is provided in a collapsed configuration and includes at least one side panel that is made of a flexible material and has an inflatable portion;

expanding the flexible containment apparatus from the collapsed configuration to an expanded configuration by inflating the inflatable portion of the flexible containment apparatus;

flushing the excess wet concrete from the concrete-handling equipment with the wash water;

transferring the wet concrete and wash water from the concrete handling equipment to the flexible containment apparatus through the discharge port of the concrete handling equipment into an opening of the flexible containment apparatus;

containing the wash water and the concrete within the flexible containment apparatus;

allowing the concrete to cure to a solidified state within the flexible containment apparatus; and disposing of the cured concrete and the flexible containment apparatus.

2. The method of claim 1, wherein the flexible containment apparatus comprises a woven polypropylene bulk bag and a water impermeable liner, and wherein the method further comprises containing the concrete and the water within the liner.

3. The method of claim 1, wherein the flexible containment apparatus is water impermeable.

4. The method of claim 1, wherein the flexible containment apparatus has at least a portion that is water permeable.

5. The method of claim 1, wherein the flexible containment apparatus has a box-shaped structure.

6. The method of claim 1, wherein the containment apparatus includes at least one strap, and further comprising the step of lifting and transporting the containment apparatus and the cured concrete by engaging the at least one strap.

7. A method of collecting a mixture of excess wet concrete and wash water from concrete handling equipment, said method comprising:

providing a water impermeable, flexible containment apparatus in a collapsed state, wherein the flexible containment apparatus includes first and second side panels and at least one inflatable panel, wherein the first and second side panels consist of flexible materials and at least one strap extending from the first side panel;

positioning an inlet of the containment apparatus adjacent a discharge port of the concrete handling equipment;

expanding the containment apparatus from the collapsed state to an expanded state by at least partially inflating the panel;

delivering the mixture of excess wet concrete and wash water from the discharge port of the concrete handling equipment to the inlet of the containment apparatus;

retaining the mixture of excess wet concrete and wash water within the containment apparatus;

allowing the concrete to cure to a solidified state within the containment apparatus;

lifting and transporting the containment apparatus and the cured concrete by engaging the at least one strap or by a secondary; and disposing of the cured concrete.

8. The method of claim 7, wherein the containment apparatus comprises a delivery tube, and wherein the method further comprises securing the delivery tube to the discharge port of the concrete handling equipment.

9. A method of collecting a mixture of excess wet concrete and wash water from concrete-handling equipment, said method comprising:

providing a flexible containment apparatus in a collapsed state, wherein the flexible containment apparatus includes at least one side panel made of a flexible material, at least one inlet, and at least one extension strap or belt;

positioning the inlet of the containment apparatus in communication with a discharge port of the concrete-handling equipment;

expanding the containment apparatus from the collapsed state to an expanded state by hanging the at least one strap or belt from the concrete-handling equipment so that in the expanded state the containment apparatus is at least partially supported in suspension from above by the at least one strap or belt and is at least partially supported from below by an underlying surface on which it rests;

flushing the excess wet concrete from the concrete-handling equipment with the wash water and thereby forming the mixture of excess wet concrete and wash water;

delivering the mixture of excess wet concrete and wash water from the discharge port of the concrete-handling equipment to the inlet of the containment apparatus while the containment apparatus is in the expanded state with the at least one strap or belt hung from the concrete-handling equipment;

retaining the mixture of excess wet concrete and wash water within the containment apparatus;

allowing the concrete to cure to a solidified state within the containment apparatus; and disposing of the cured concrete.

10. The method of claim 9, wherein the containment apparatus comprises a delivery tube, and wherein the method further comprises securing the delivery tube to the discharge port of the concrete handling equipment.

11. The method of claim 9, wherein the containment apparatus is water impermeable.

12. The method of claim 9, wherein the containment apparatus includes at least one fold line about which the at least one side panel unfolds when expanding the containment apparatus from the collapsed state to the expanded state.

13. The method of claim 9, wherein the containment apparatus has at least a portion that is water permeable.

14. The method of claim 9, wherein the containment apparatus has a box-shaped structure.

15. The method of claim 14, wherein the at least one side panel comprises four side panels.

16. The method of claim 9, further comprising the step of lifting and transporting the containment apparatus and the cured concrete by engaging the at least one strap or belt or a secondary strap or belt.

17. The method of claim 9, wherein the underlying surface is the ground.

18. The method of claim 9, wherein the at least one strap comprises four straps.

19. The method of claim 9, wherein the containment apparatus includes a top panel that defines the inlet.

20. The method of claim 19, wherein the inlet is positioned off-center in the top panel.

21. The method of claim 19, wherein the at least one strap or belt that hangs from the concrete-handling equipment to maintain the containment apparatus in the expanded state extends from the top panel adjacent the inlet.

* * * * *

UNITED STATES PATENT AND TRADEMARK OFFICE

CERTIFICATE OF CORRECTION

PATENT NO. : 8,113,220 B2
APPLICATION NO. : 12/142711
DATED : February 14, 2012
INVENTOR(S) : Pat Inglese It is certified that error appears in the above-identified patent and that said Letters Patent is hereby corrected as shown below:

In the Specifications:

At column 6, line 49, after "support mounts," and before "175a," insert --(e.g., belts).--.

Signed and Sealed this
Thirtieth Day of April, 2013

Teresa Stanek Rea
*Acting Director of the United States Patent and Trademark Office*